United States Patent [19]

Matsuda

[11] Patent Number: 4,651,661

[45] Date of Patent: Mar. 24, 1987

[54] ASSEMBLY CONSTRUCTION FOR SEWING MACHINE

[75] Inventor: Kimikazu Matsuda, Tsuzuki, Japan

[73] Assignee: Maruzen Sewing Machine Co., Ltd., Osaka, Japan

[21] Appl. No.: 889,311

[22] Filed: Jul. 25, 1986

Related U.S. Application Data

[63] Continuation-in-part of Ser. No. 804,932, Dec. 5, 1985.

[51] Int. Cl.[4] ..... D05B 73/02

[52] U.S. Cl. ..... 112/254; 112/259

[58] Field of Search ..... 112/259, 258, 254, 255

[56] References Cited

U.S. PATENT DOCUMENTS

| | | | |
|---|---|---|---|
| 2,497,651 | 2/1950 | Austlid | 112/258 |
| 2,724,355 | 11/1955 | Heimann | 112/258 |
| 3,253,564 | 5/1966 | Gustin | 112/258 |
| 3,721,205 | 3/1973 | Ono et al. | 112/254 |
| 3,792,674 | 2/1974 | Casas-Robert | 112/254 |
| 3,841,248 | 10/1974 | Adams et al. | 112/254 |
| 3,863,581 | 2/1975 | Kohara et al. | 112/255 |
| 3,866,553 | 2/1975 | Adams et al. | 112/258 |
| 4,044,701 | 8/1977 | Giesselmann et al. | 112/259 |
| 4,193,361 | 3/1980 | Johnson | 112/259 |
| 4,421,042 | 12/1983 | Killinger | 112/259 |

FOREIGN PATENT DOCUMENTS

| | | | |
|---|---|---|---|
| 2421683 | 11/1974 | Fed. Rep. of Germany | 112/259 |
| 2312587 | 12/1976 | France | 112/259 |

*Primary Examiner*—H. Hampton Hunter

*Attorney, Agent, or Firm*—Lowe Price Leblanc Becker & Shur

[57] ABSTRACT

The frame of a sewing machine is divided into a rear frame section (1) and a front cover (2). Mounted on seats formed on the rear frame section (1) are such components as an arm shaft unit (4), a loop taker unit (10), a presser and needle bar unit (3) and a bottom arm shaft unit (8). Mounted on the front cover (2) are a bobbin winder (60), operating panels (83, 84), control knob (68), etc. A pattern selecting dial (26), a reverse lever (32), a work feed control dial (87), etc. are held by mechanism components mounted on the rear frame section (1) and are exposed to the outside through openings (61, 62) in the front cover (2).

5 Claims, 16 Drawing Figures

ASSEMBLY CONSTRUCTION FOR SEWING MACHINE

RELATED APPLICATIONS

The present application is a continuation-in-part of U.S. patent application Ser. No. 804,932 filed Dec. 5, 1985.

FIELD OF THE INVENTION

This invention relates to an assembly construction for a sewing machine and more particularly it relates to an assembly construction for a sewing machine so designed that the presser and needle bar unit, loop taker unit, and work feeding mechanism and the components of various mechanisms including the operating mechanisms therefor can be easily assembled and adjusted.

DESCRIPTION OF THE PRIOR ART

An arrangement for a sewing machine is known in which the rear or front surface of the machine frame is opened to install various mechanism components.

For example, in U.S. Pat. No. 4,044,701 issued to Giesselmann et al. on Aug. 30, 1977, various mechanism components and devices in pre-assembled condition are mounted on seats formed in advance on the frame. It is also disclosed therein that the sewing machine is so arranged that these components can be adjusted for proper positioning during assembly operation. According to this U.S. Patent, a great contribution is made to increasing the efficiency of assembly operation in that various mechanism components in pre-assembled condition are mounted on seats formed in advance on the frame.

In such assembly construction, however, it often occurs that in order to replace a component which is susceptible to damage and which requires frequent replacement, some main mechanism components must be loosened and removed before the replacement operation can be performed. The reason is that such components requiring frequent replacement are attached to the frame prior to the main mechanism components. Examples of the components requiring frequent replacement are operating mechanism components including dials and levers which are most frequently manipulated by the sewer and which are liable to be damaged because they are mounted partly exposed beyond the machine frame, and the hook point of the loop taker liable to be damaged by the needle during sewing operation. The operation of loosening and removing main mechanism components simply to replace a damaged component is troublesome, as described above, moreover, this operation results in disturbing the proper positional relation between mechanism components, so that readjustment is required after replacement. Further, functional adjustment of the sewing machine subsequent to completion of assembly operation is very troublesome since it involves adjusting the relative positions of mechanism components from the rear side while manipulating the operating members disposed on the front of the machine and connected to various mechanism components.

U.S. Pat. No. 4,193,361 issued to Johnson on Mar. 18, 1980 discloses an assembly method wherein a frame entirely opened in the front is formed with seats machine-finished to the same level and various mechanism components are mounted on these seats. This method is very advantageous in that it eliminates the cumulative errors in mounting dimensions between components in the conventional frame, which errors result from the fact the seats for mounting components differ in height according to the shape and size of these components.

With this assembly construction, however, the advantage of the seats for mounting components being flush with each other is attended with limitations on the shape and size of components, complicating the shape of components.

Further, this Johnson Patent also discloses that all of the driving mechanism components and operating mechanism components, which are housed in or held by the frame, are divided substantially into two groups, one associated with the arm shaft and the other with the bottom arm shaft, for general unitization purposes.

In assembling these two generally unitized subassemblies, however, there is no denying that substantially the same number of operating steps and the same amount of operating time are involved as in the conventional sewing machine. Further, the handling, such as transfer, of the subassemblies is inconvenient. For these reasons, the assembly construction of Johnson Patent cannot absolutely be said to be advantageous.

SUMMARY OF THE INVENTION

Accordingly, an object of this invention is to provide an assembly construction for a sewing machine, whereby the various mechanism components included in the sewing machine can be easily assembled and adjusted.

A sewing machine according to this invention has a machine frame which comprises a rear frame section and a front cover of resin, said section and cover being adapted to be joined together. The various mechanism components included in this sewing machine are roughly classified into driving mechanism components and operating mechanism components. The driving mechanism components are held by the rear frame section. The rear frame section is opened in the front and has seats for mounting the driving mechanism components. The operating mechanism components are installed so that they appear outwardly of the front cover. The front cover is opened in the rear and has a plurality of openings for receiving the operating mechanism components and allowing them to appear in the outside. The operating mechanism components are divided into first and second operating mechanism components. The first operating mechanism components, when held by the front cover, appear outwardly of the openings in the front cover. The second operating mechanism components are held by driving mechanism components associated therewith and in this condition they appear outwardly of the openings in the front cover.

A thread tensioning device is also mounted to the rear frame section via seats provided in the latter. The thread tensioning device includes a thread tension control knob that is exposed in the front cover through an opening therein.

Examples of the driving mechanism components are the arm shaft, bottom arm shaft, presser and needle bar unit, work feeding mechanism, loop taker unit, and electric motor. Examples of the operating mechanism components are the upper thread tension control knob, zigzag stitch width control knob, pattern selecting dial, reverse lever, and work feed control dial.

According to this invention, since the assembly operation of the sewing machine can be performed, starting with those components which are to be disposed in the rearmost region, it follows that the assembly operation can be performed with the operator facing in the direction in which the sewer uses the sewing machine. That is, first, main mechanism components including the driving mechanism components are mounted on the rear frame section and then some operating mechanism components are assembled to the driving mechanism components associated therewith, whereupon the assembly operation associated with the rear frame section is completed. Subsequently, some of the operating mechanism components, such as the dials and levers, and such components as the bobbin winder, are mounted in advance on the front cover, and then the front cover is fixedly fitted to the rear frame section. Thus, the assembly operation, which is performed in this manner, is efficient.

Further, since some of the operating mechanism components, such as the dials and levers, appearing in the outside and such components as the bobbin winder, are mounted on the front cover in advance, the operation of assembling the mechanism components on the rear frame section can be performed concurrently with the operation of assembling said components on the front cover; thus, the operating efficiency is high.

Further, with the rear side of the sewing machine, i.e., the rear frame section, which has almost no mechanism components projecting outward or operating members exposed to the outside, being used as a base, various mechanism components and front cover are mounted; therefore, with the rear frame section turned rearward with its back side facing down, the assembly operation can be performed.

Functional ascertainment and adjustment of the sewing machine can be made midway through the assembly operation when main driving mechanism components and operating mechanism components are mounted on the rear frame section. Therefore, in making such functional ascertainment and adjustment, there is not need to move the machine frame or change its direction.

Further, since the front cover can be molded of resin with any desired color and design, sewing machines meeting consumer's varying needs can be produced at low cost.

Further, in removing an operating mechanism component requiring frequent replacement, the front cover can be removed while the mechanism components built in the rear frame section are held in the correct positional relation; therefore, not only is there no need of a post-operation for adjustment, but also replacement of components is easy.

Further, an operating panel and an ornamental panel may be attached as desired to the front cover. Therefore, if these panels are removably installed on the front cover and if portions of the front cover which are hidden by these panels are formed with work windows for adjustment, then maintenance of the mechanism components in the frame can be facilitated.

This object and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
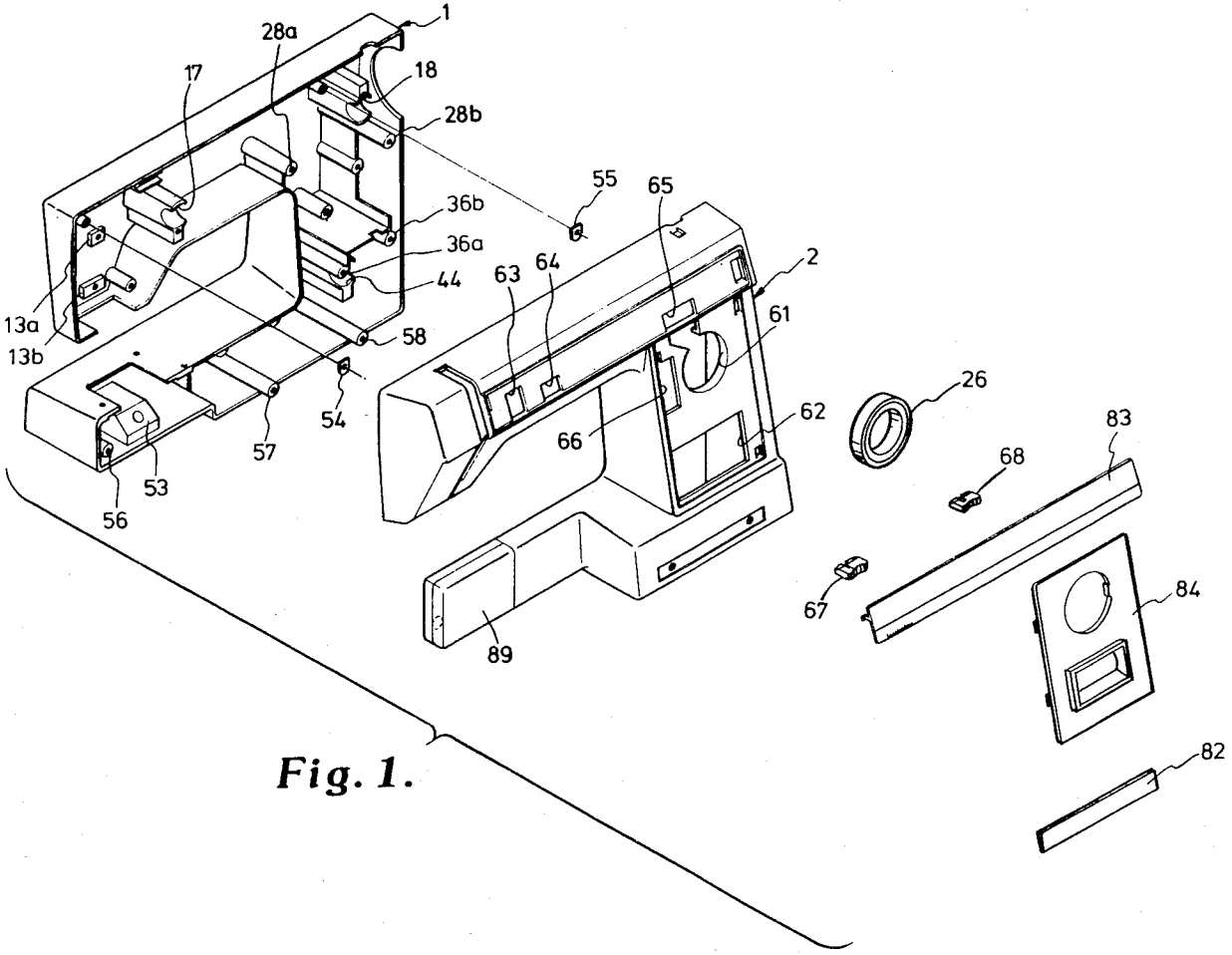
FIG. 1 is an exploded perspective view of a sewing machine frame according to an embodiment of this invention, with almost all mechanism components being omitted from the illustration.

The accompanying drawings are for the purpose of explaining a free arm type zigzag sewing machine, the sewing machine frame, as shown in FIG. 1, being divided into two parts, a rear frame section 1 on the rear side and a front cover 2 on the front side.

Figure 3:
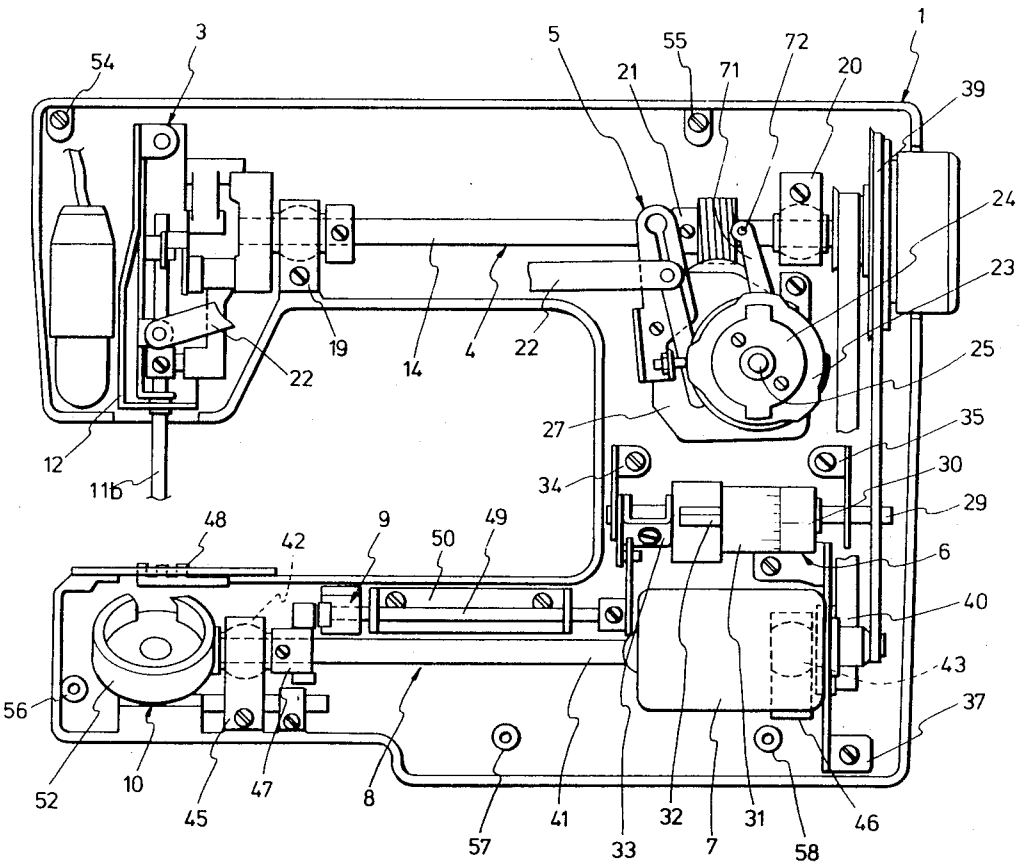
FIG. 3 is a front view of the rear frame section of FIG. 1, with various mechanism components mounted thereon.

The rear frame section 1, as shown in FIG. 3, holds a presser and needle bar unit 3, an arm shaft unit 4, a zigzag stitch producing and pattern selecting mechanism 5, a work feed regulating mechanism 6, an electric motor 7, a bottom arm shaft unit 8, a work feeding mechanism 9, a thread tension control 59*a*, and a loop taker unit 10. The rear frame section 1, which is die-cast of aluminum or the like, is integrally formed with a plurality of seats for mounting the aforesaid mechanism components.

Figure 6:
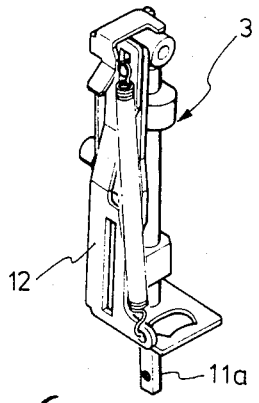
FIG. 6 is a perspective view of a presser and needle bar unit shown in FIG. 3.

The presser and needle bar unit 3, as singly shown in FIG. 6, includes a support member 12 which carries a presser bar 11*a* and supports a needle bar 11*b* (not shown in FIG. 6, but shown in FIG. 3) for zigzag motion and for up-down reciprocating motion. The presser and needle bar unit 3 is mounted on the support seats 13*a* and 13*b*, as shown in FIG. 1, of the rear frame section 1 through the support member 12.

Figure 7:
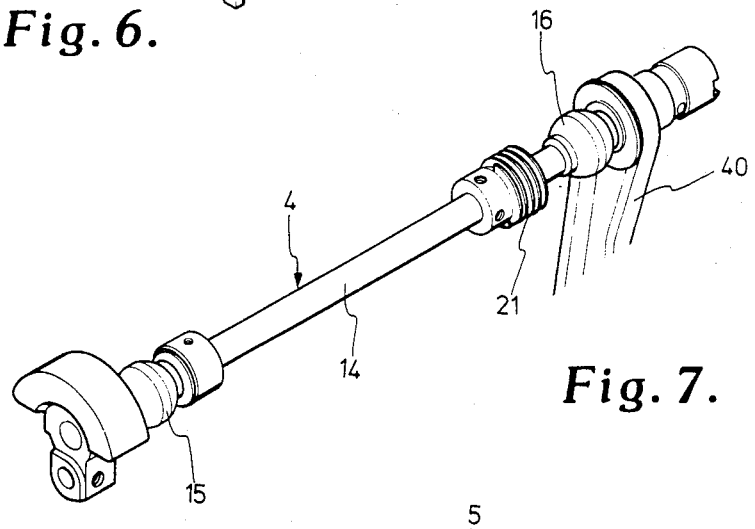
FIG. 7 is a perspective view of an arm shaft unit shown in FIG. 3.

The arm shaft unit 4, as singly shown in FIG. 7, includes an arm shaft 14, and is mounted on the rear frame section 1 through spherical bearings 15 and 16. The rear frame section 1, as shown in FIG. 1, is formed with seats 17 and 18 for the bearings 15 and 16; the bearings 15 and 16, as received in the seats 17 and 18, are fixed in position by holder plates 19 and 20, as shown in FIG. 3.

Figure 8:
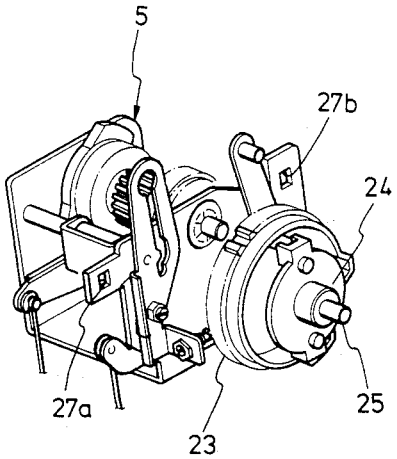
FIG. 8 is a perspective view of a zigzag stitch producing and pattern selecting mechanism.

The zigzag stitch producing and pattern selecting mechanism 5 is singly shown in FIG. 8. The zigzag stitch producing and pattern selecting mechanism 5, as shown in FIG. 3, forms a transmission system for imparting zigzag motion from a gear 21 to a zigzag rod 22. The zigzag rod 22 imparts zigzag motion to the needle bar 11. The type of zigzag motion to be imparted to the zigzag rod 22 is controlled by rotation around the axis of a shaft 25 of a selection dial support member 24 fixed to a cam 23. As will be later described, the selection dial support member 24 will have fixed thereto a pattern selecting dial 26 (FIGS. 1, 2 and 13) after the front cover 2 has been joined to the rear frame section 1. Such zigzag stitch producing and pattern selecting mechanism 5 has mounting elements 27*a* and 27*b*, through which it is mounted on the rear frame section 1. The rear frame section 1, as shown in FIG. 1, has seats 28*a* and 28*b* for mounting the mounting elements 27*a* and 27*b*.

The work feed regulating mechanism 6, which serves to regulate the travel of a feed-dog 48 of the work feeding mechanism 9, includes a stitch length indicating body 30, a stitch length display member 31, and a reverse lever 32. The reverse lever 32 is used to reverse the direction of feed of cloth in the work feeding mechanism 9. Further, the work feed regulating mechanism 6 is provided with a feed actuation lever 33 for changing the travel of the feed-dog 48 of the work feeding mechanism 9 by changing the angle of inclination of said feed actuation lever 33. The work feed regulating mechanism 6 has mounting plates 34 and 35, through which it is mounted on the rear frame section 1. The rear frame section 1, as shown in FIG. 1, has seats 36*a* and 36*b* for mounting the mounting plates 34 and 35.

The electric motor 7 is mounted on the rear frame section 1 through a mounting plate 37. The rear frame section 1 has a seat (not shown) for mounting the mounting plate 37. The rotation of the motor 7 is transmitted to the arm shaft 14 through a belt 39, the rotation of which arm shaft 14 is transmitted through a belt 40 to the bottom arm shaft 41 of the bottom arm shaft unit 8.

Figure 9:
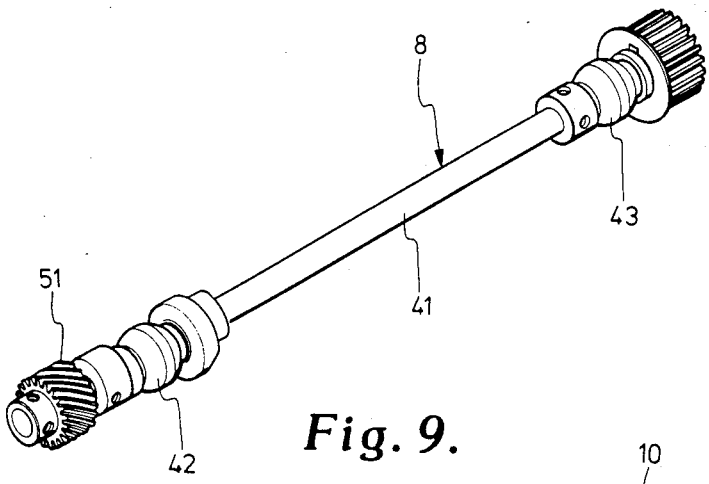
FIG. 9 is a perspective view of an bottom arm shaft unit shown in FIG. 3.
Figure 10:
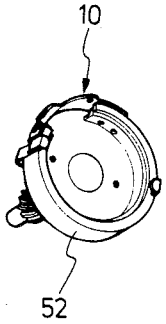
FIG. 10 is a perspective view of a loop taker unit shown in FIG. 3.

The bottom arm shaft unit 8, as singly shown in FIG. 9, has two spherical bearings 42 and 43 on said bottom arm shaft 41. The bottom arm shaft unit 8 is mounted on the rear frame section 1 through these bearings 42 and 43. That is, the rear frame section 1 is formed with seats (a seat 44 alone being shown) for supporting these bearings 42 and 43. The bearings 42 and 43 supported on the seats are fixed in position by holder plates 45 and 46, respectively.

The work feeding mechanism 9 has a feed cam 47 attached to the bottom arm shaft 41, said feed cam 47 exerting a force to drive a feed-dog 48. The amount of movement of said feed-dog 48 is controlled by the angle of rotation of a shaft 49 operated by the aforesaid work feed regulating mechanism 6. The shaft 49 is mounted on the rear frame section 1 through a mounting plate 50. The rear frame section 1 is formed with a seat (not shown) for mounting said mounting plate 50.

The loop taker unit 10 has a loop taker 52 fixed to a spiral gear (not shown) which meshes with a spiral gear 51 fixed on one end of the bottom arm shaft 41 shown in FIG. 9 and which is thereby rotated. The loop taker unit 10 is unitized as singly shown in FIG. 9 and is mounted on a seat 53 on the rear frame section 1 shown in FIG. 1.

Figure 11:
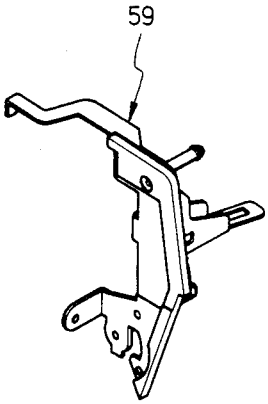
FIG. 11 is a perspective view of a thread tensioning device unit shown in FIG. 4.

The rear frame section 1 also supports a thread tensioning device 59A (FIG. 11) having a horizontal base 59 provided at opposite ends thereof with mounting elements 59D and 59E. The elements 59D,59E secure the tension device 59A to rear frame mounting seats 59B and 59C (FIG. 11 only) by means of screws (FIG. 3). Thread tension control device 59A further includes a thread tension control mechanism 59H supporting a thread tension control dial 59F. An opening 59G provided in front cover 2 at the upper left hand corner thereof receives dial 59F, as depicted in FIGS. 2 and 5, thereby displaying the dial 59F through the front cover for adjustment of thread tension during sewing machine operation.

Further, the rear frame section 1 is provided with latches 54 and 55 and internally threaded fixing bosses 56, 57 and 58 for connection to the front cover 2.

Figure 4:
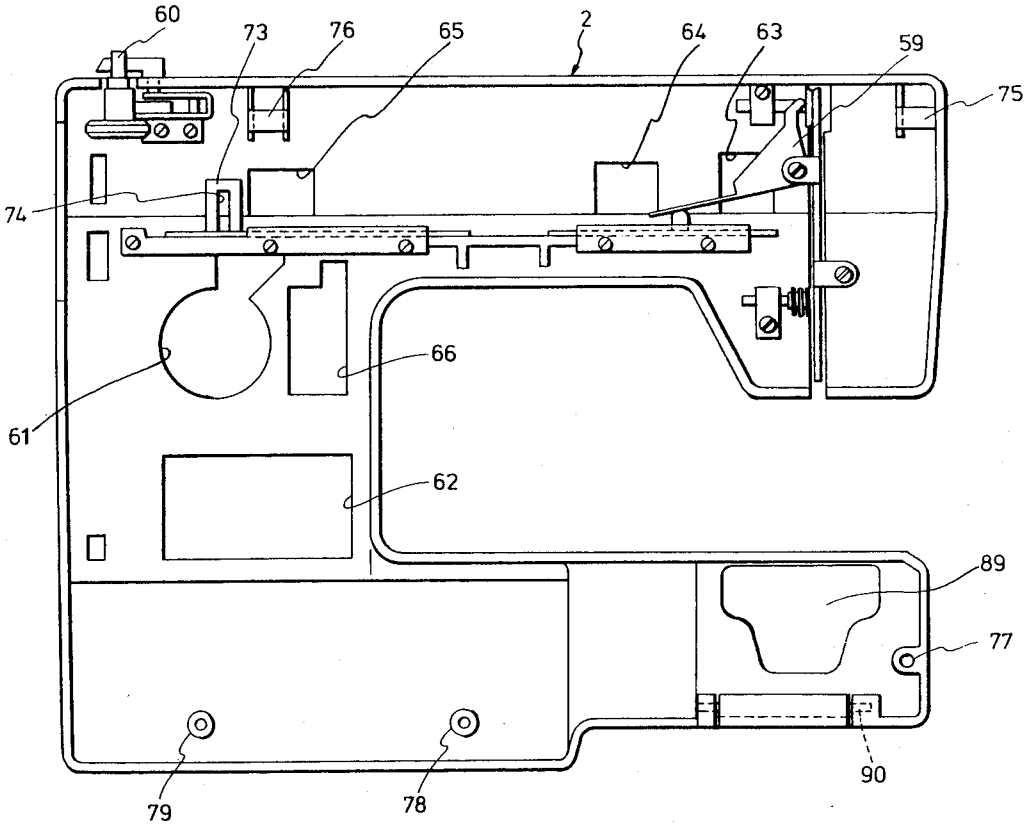
FIG. 4 is a rear view of the front cover of FIG. 1, where various mechanism components are mounted thereon.
Figure 12:
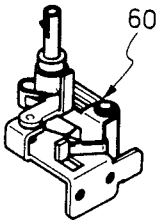
FIG. 12 is a perspective view of a bobbin winder shown in FIG. 4.

As shown in FIG. 3, after various mechanism components have been mounted on the rear frame section 1, the front cover 2 is joined to the rear frame section 1. At this time, the front cover 2, as shown in FIG. 4, has some mechanism components held thereon in advance. That is, the bobbin winder 60 singly shown in FIG. 12 has been mounted on the front cover 2. The front cover 2 is molded of resin and has openings 61 and 62 for allowing various operating mechanism components to appear in the outside. It is formed with a plurality of work windows 63, 64, 65 and 66 to enable various mechanism components held on the rear frame section 1 to be adjusted from the outside.

Figure 2:
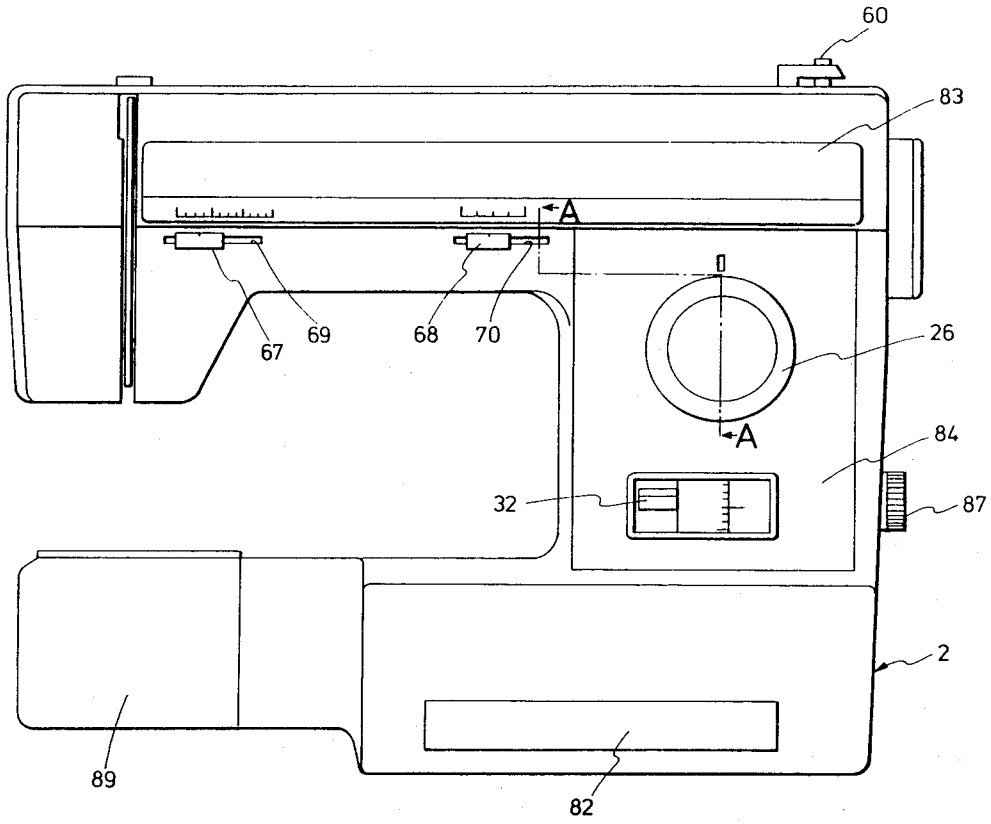
FIG. 2 is a front view of the sewing machine of FIG. 1 shown in its assembled state.
Figure 5:
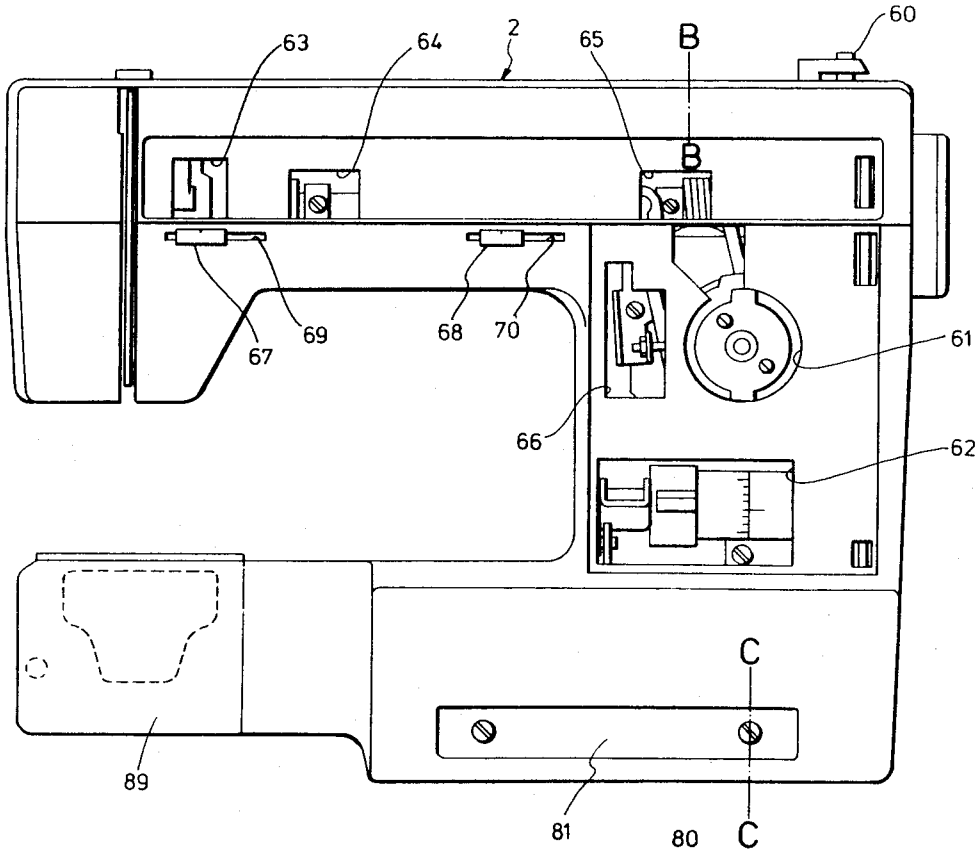
FIG. 5 is a front view showing a state in which the front cover of FIG. 4 having various mechanism components assembled thereto is combined with the rear frame section of FIG. 3 having various mechanism components assembled thereto.
Figure 13:
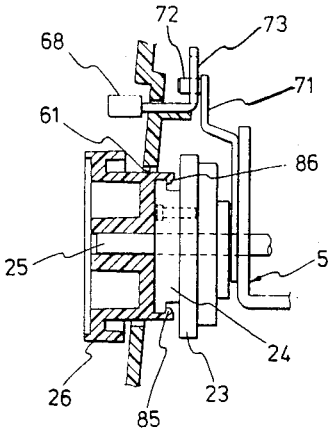
FIG. 13 is a sectional view taken along the line A—A in FIG. 2.

Further, held on the front cover 2, as shown in FIGS. 2 and 5, is a zigzag stitch width control knob 68. Control knob 68 is installed for sliding movement along slit 70. Particularly, when the front cover 2 is joined to the rear frame section 1, the zigzag stitch width control knob 68 engages a portion of the associated mechanism component held by the rear frame section 1. That is, the zigzag stitch width control knob 68, which is used to adjust the zigzag stitch width, as shown in FIG. 13, adjusts the angle of the lever 71 included in the zigzag stitch producing and pattern selecting mechanism 5 in that a pin-like body 72 provided on the lever 71 engages a throughgoing hole 74 (FIG. 4) formed in a connecting slider 73 extending from the zigzag stitch width control knob 68. Further, the rotary movement of the thread tension control dial 59F is imparted to the thread tensioning device unit 59A, whereby the tension to be imparted to the upper thread is adjusted.

Further, the front cover 2, as shown in FIG. 4, is formed with latches 75 and 76 and mounting bosses 77, 78 and 79 each having a throughgoing hole, for fixing the joined state of the front cover 2 and rear frame section 1.

Further, the front cover 2, as shown in FIGS. 1, 2, 4 and 5, is provided with a bobbin access cover 89 for giving access to a bobbin (not shown) retained by the loop taker 52. The bobbin access cover 89 is pivotally attached to the front cover 2 by a hinge 90.

Figure 15:
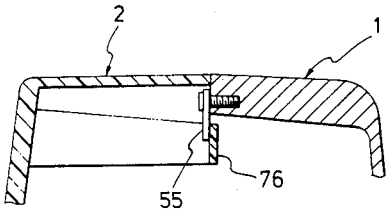
FIG. 15 is a sectional view taken along the line B—B in FIG. 5.

When the front cover 2 is fixed to the rear frame section 1, said latches 75 and 76 engage the latches 54 and 55, respectively, provided on the rear frame section 1. The front cover 2 is positioned on the rear frame section 1 so that the latch 76 engages the latch 55, as shown in FIG. 15. In this state, mounting screws are inserted in throughgoing holes formed in the mounting bosses 77, 78 and 79 of the front cover 2, and are threadedly engaged with the internal threads of the fixing bosses 56, 57 and 58 formed on the rear frame section 1.

Figure 16:
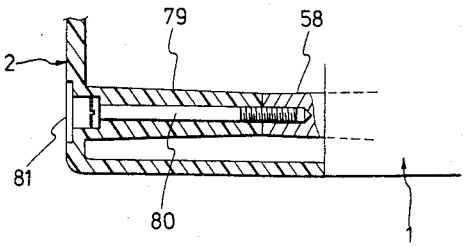
FIG. 16 is a sectional view taken along the line C—C in FIG. 5.

For example, as shown in FIG. 16, a mounting screw 80 is inserted in the mounting boss 79 and engaged with the internal thread of the fixing boss 58. As can be seen from a comparison between FIGS. 2 and 5, an ornamental plate 82 may be applied to a recess 81 in which the head of the mounting screw 80 is exposed.

When the front cover 2 is joined to the rear frame section 1, as shown in FIG. 5, some of the various mechanism components held by the rear frame section 1 appear through the work windows 63, 64, 65 and 66.

Therefore, various mechanism components included in this sewing machine can be adjusted while the front cover 2 is held joined to the rear frame section 1. These work windows can be hidden by mounting operating panels 83 and 84 shown developed in FIG. 1 at predetermined positions on the front cover 2, as shown in FIG. 2. The operating panels 83 and 84 are made of resin and are preferably so arranged that they can be easily removably attached to the front cover 2 as by a snap connection.

Further, after the front cover 2 has been mounted on the rear frame section 1, the aforesaid pattern selecting dial 26 is attached to the selecting dial support member 24 included in the zigzag stitch producing and pattern selecting mechanism 5. As shown in FIG. 13, the pattern selecting dial 26, with the shaft 25 received therein, is fixed to the selecting dial support member 24 by engaging hooks 85 and 86 with the selecting dial support member 24.

Figure 14:
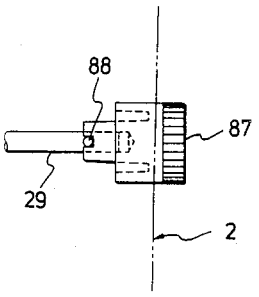
FIG. 14 is a view showing how the work feed control dial of FIG. 2 and the shaft of FIG. 3 are joined together.

Further, as shown in FIG. 14, laterally of the front cover 2, a work feed control dial 87 is fitted on the shaft 29 included in the work feed regulating mechanism 6. Though not shown, the front cover 2 is formed with an opening for receiving the work feed control dial 87. The work feed control dial 87 is installed for rotation integrally with the shaft 29 by engaging a pin 88 provided on the shaft 29.

When the sewing machine is assembled as shown in FIG. 2, the pattern selecting dial 26, reverse lever 32, thread tension control dial 59F, zigzag stitch width control knob 68, and work feed control dial 87 appear outwardly of the front control 2. Of these elements, the pattern selecting dial 26, reverse lever 32, dial 59F and work feed control dial 87 are held by mechanism components held on the rear frame section 1. On the other hand, the zigzag stitch width control knob 68 is held on the front cover 2. Further, the zigzag stitch width control knob 68 is so arranged that when the front cover 2 is joined to the rear frame section 1, the zigzag stitch width control knob engages a mechanism component.

In the embodiment described, various mechanism components are unitized to make assembly operation more efficient. However, such manner of unitization can be variously changed. Further, it is also possible to mount components one by one on the rear frame section rather than unitizing and then mounting them.

In addition, a part corresponding to the aforesaid bobbin access cover 89 may be fixed directly to the rear frame section 1 rather than being retained by the front cover 2.

Further, a sewing machine may further comprise a base (not shown) so that the frame formed of the rear frame section and front cover which are joined together can be stably set on a suitable table.

Although the present invention has been described and illustrated in detail, it is clearly understood that the same is by way of illustration and example only and is not to be taken by way of limitation, the scope of the present invention being limited only by the terms of the appended claims.

What is claimed is:

1. A sewing machine comprising:

a sewing machine frame formed of a rear frame section (1) and a front cover (2) of resin which are jointed together;

a plurality of driving mechanism components (3, 4, 5, 6, 7, 8, 9, 10) and a thread tensioning device (59A), which are held by the rear frame section;

said rear frame section being opened in the front and having seats (13, 17, 18, 28, 36, 44, 53, 59B, 59C) for supporting said driving mechanism components and said thread tensioning device;

a plurality of operating mechanism components (26, 32, 67, 68, 87, 59F) and a thread tension control (59F), which are so installed that they appear outwardly of said front cover;

said front cover being opened in the rear and having a plurality of openings (61, 62, 69, 68, 59G) for receiving said plurality of operating mechanism components and allowing them to appear in the outside;

said plurality of operating mechanism components including first operating mechanism components and second operating mechanism components, said first operating mechanism components (68) being held by said front cover, said second operating mechanism components (26, 32, 87) being held by those of said driving mechanism components which are associated therewith; and said thread tension control being held by said thread tensioning device.

2. The sewing machine of claim 1, wherein said thread tension control is a rotary dial displayed through the front cover by means of an opening (59G) in which said dial is disposed.

3. The machine of claim 2, wherein said thread tensioning device includes a base formed with mounting elements at opposite ends thereof, said mounting elements adapted to engage a pair of rear frame mounting seats, respectively, projecting from said rear frame section for securement thereto with screws.

4. The machine of claim 3, wherein said front cover opening through which the thread tension control dial projects is located in an upper left hand corner of the front cover.

5. The machine of claim 4, wherein said rear frame mounting seats are in the form of cylindrical threaded hubs projecting from a rear inner wall of said rear frame section.

* * * * *